US005542679A

United States Patent [19]

Caso

[11] Patent Number: 5,542,679

[45] Date of Patent: Aug. 6, 1996

[54] GROUND MOUNTED APPLIANCE WITH LEG JOINT

[76] Inventor: Frank J. Caso, 11 Victor Ave., Eatontown, N.J. 07724

[21] Appl. No.: 474,676

[22] Filed: Jun. 7, 1995

[51] Int. Cl.[6] ..... A63B 69/00; A47B 13/02

[52] U.S. Cl. ..... 273/413; 108/150; 273/1.5 R; 273/26 E; 273/29 BB

[58] Field of Search ..... 273/26 E, 1.5 RA, 273/29 A, 29 B, 29 BA, 29 BB, 55 R, 55 D, 336, 348, 413; 40/598, 601, 624; 108/2, 4, 150

[56] References Cited

U.S. PATENT DOCUMENTS

| | | | |
|---|---|---|---|
| D. 312,857 | 12/1990 | Montelongo | D21/210 |
| 518,930 | 4/1894 | Allen | 273/336 |
| 1,959,574 | 5/1934 | Dunscombe | 273/29 B |
| 2,292,785 | 8/1942 | Henne | 40/598 |
| 4,793,612 | 12/1988 | Hammond | 273/26 E |
| 4,830,371 | 5/1989 | Lay | 273/26 E |
| 4,979,741 | 12/1990 | Butcher | 273/26 R |
| 5,071,122 | 12/1991 | Messina | 273/26 R |
| 5,135,219 | 8/1992 | McKeon et al. | 273/26 E |
| 5,186,119 | 2/1993 | Hlavin | 40/598 X |
| 5,226,646 | 7/1993 | Levatino | 273/26 R |
| 5,228,683 | 7/1993 | Beimel | 273/26 R |
| 5,230,506 | 7/1993 | Cipriano et al. | 273/26 R |

*Primary Examiner*—William H. Grieb
*Attorney, Agent, or Firm*—Terrance L. Siemens

[57] ABSTRACT

A leg for an outdoors appliance, such as a batting aid having a tethered ball, a basketball hoop assembly, a tennis net, or a table. The leg has upper and lower sections connected by a coil spring. A sleeve driven into the ground receives the leg to a sufficient depth of penetration that the spring is also received within the sleeve. The appliance is thus rigidly supported in the sleeve. The leg, or legs in the case of appliances requiring more than one leg, is manually withdrawn from the sleeve to expose the spring. The spring provides a flexible joint, and the appliance can be inclined toward the ground when the spring has been moved out of the sleeve. This enables service to the item atop the leg or legs. Illustratively, should the tether of the batting aid become wound around the horizontal post to which it is attached, it is easily reached when the appliance is manually inclined. The appliance is readily removed from the sleeve for seasonal storage, and is readily reerected. The sleeve has a cap for safety and to prevent clogging when not in use. The cap may be formed to have a shallow recess, so that the sleeve serves as a golf hole.

10 Claims, 3 Drawing Sheets

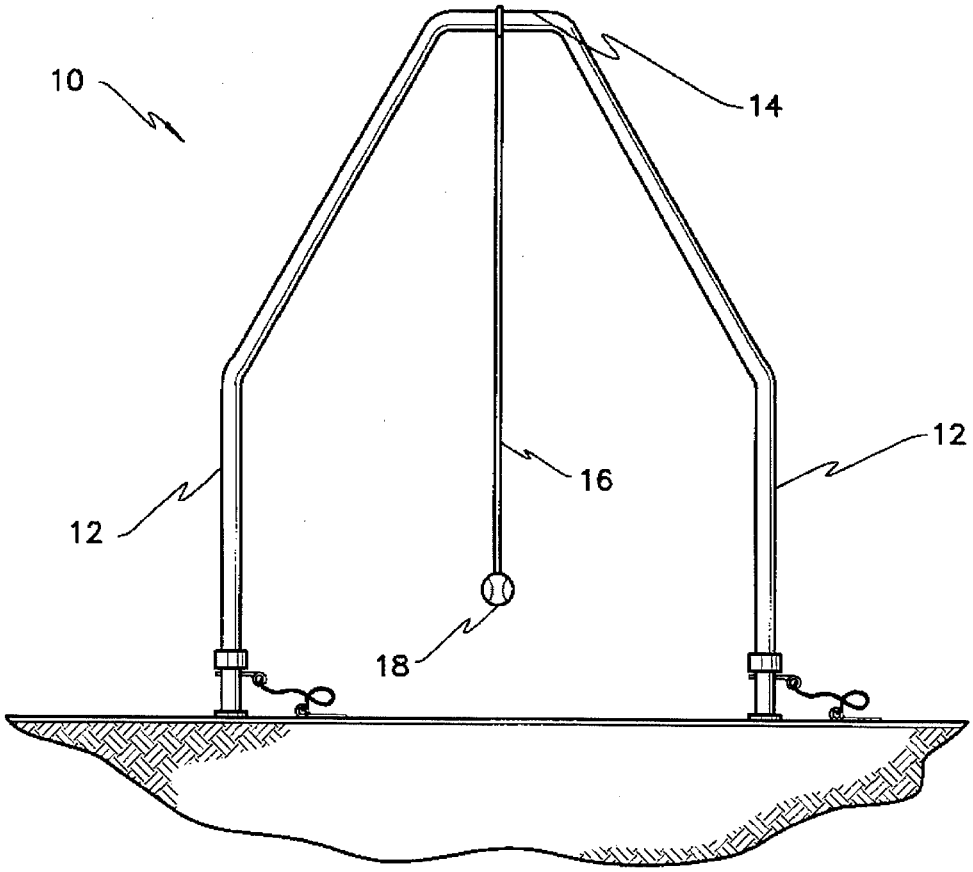
FIG. 1
FIG. 5
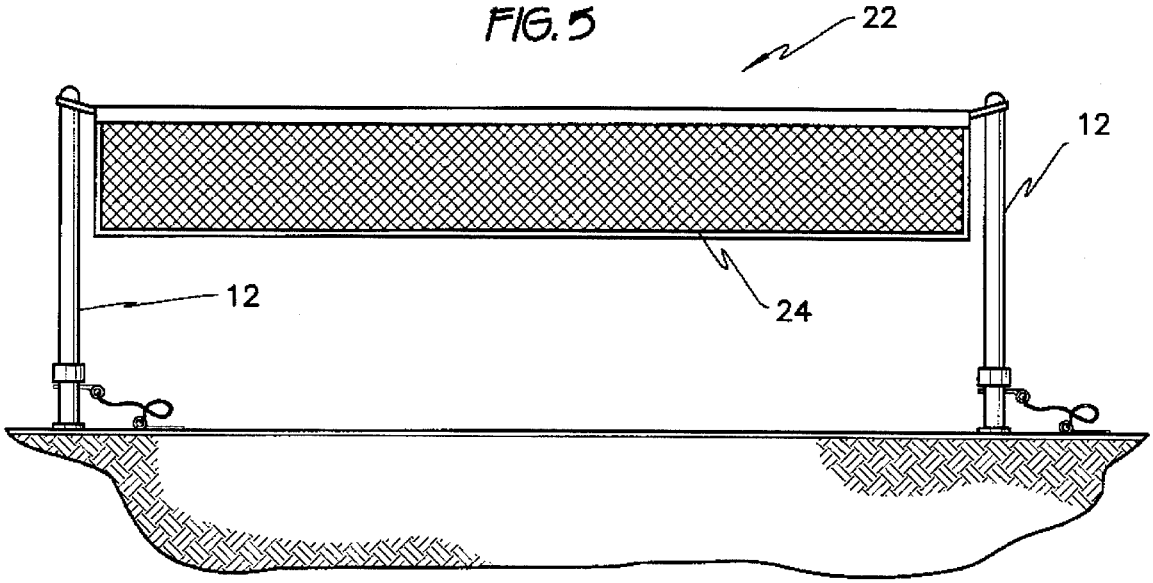

GROUND MOUNTED APPLIANCE WITH LEG JOINT

BACKGROUND OF THE INVENTION

1. Field of the Invention

The present invention relates to appliances, most advantageously to sports accessories such as batting aids, which are customarily supported on a member or leg anchored in the ground. The appliance has a leg which is secured in the ground by occupying a ground mounted sleeve. A flexible joint located in the leg above ground enables the appliance to be pulled towards the ground temporarily, for service, disassembly, or other purposes.

2. Description of the Prior Art

Sports accessories such as batting aids require considerable space, and are therefore frequently located outdoors. This location accommodates the relatively great span of tethered balls, which are frequently employed for softball batting practice, as well as for games requiring tethered balls.

Batting practice has requirements which would render many simple tethered ball arrangements unsuitable. Notably, the batter must be able to stand near a tethered ball and be able to swing his or her bat through a generally horizontal arc without interference from supporting posts of the practice device. Accordingly, most batting aids have a tethered ball, or other target, spaced horizontally from a vertical support post.

U.S. Pat No. 5,135,219, issued to Tim O. McKeon et al. on Aug. 4, 1992, is exemplary. McKeon et al. provide a vertical post which is embedded within the ground. By contrast, the present invention has two vertical posts each having a flexible joint to facilitate drawing the horizontal post downwardly in order to free a ball which has become wound thereon. In U.S. Pat. No. 4,793,612, issued to Robert G. Hammond on Dec. 27, 1988, a batting aid is set forth which also includes a single vertical support post.

A problem frequently encountered in tethered ball type batting aids is that the ball will occasionally cause the tether to wind around a structural post. McKeon et al. provide a second tether to prevent the ball from assuming a trajectory which would cause unintended winding at a point on the support posts which is out of easy reach. This second tether may possibly be objectionable, since it will inevitably be struck by the bat, and will entangle with the bat to a certain extent. This causes a departure from actual batting conditions. Hammond mounts his tether to a rotatable member secured to a horizontal support shaft. It would be possible for the tether to wind about this shaft in some circumstances, particularly when the plane of the struck ball is not vertical. The present invention avoids the complication of providing firstly, a rotatable member and secondly, a brace necessary for supporting the horizontal shaft.

In U.S. Pat. No. 4,979,741, issued to Gary J. Butcher on Dec. 25, 1990, and U.S. Pat. No. Des. 312,857, issued to Isaac Montelongo on Dec. 11, 1990, batting aids having a single vertical support post are shown. Butcher's the aid is supported on a horizontal plate which rests on the ground. Montelongo's vertical post has a stake driven into the ground. Both devices lack the two vertical posts and particularly the flexible joint of the present invention.

In U.S. Pat. No. 5,071,122, issued to Joseph A. Messina on Dec. 10, 1991, U.S. Pat. No. 5,226,646, issued to Samuel R. Levatino on Jul. 13, 1993, and U.S. Pat. No. 5,228,683, issued to Roger G. Beimel on Jul. 20, 1993, a central vertical support post is secured to at least one horizontal post to which the ball is attached. The vertical post is secured by several legs disposed in a horizontal plane. These devices lack the flexible joint and ground penetration of the present invention, and have one vertical post rather than two.

U.S. Pat. No. 5,230,506, issued to Ronald J. Cipriano et al. on Jul. 26, 1993, features a batting aid held by a second person. The subject device is not free standing, as is that of the present invention, and lacks a flexible joint and the two vertical support posts of the present invention.

None of the above inventions and patents, taken either singly or in combination, is seen to describe the instant invention as claimed.

SUMMARY OF THE INVENTION

The present invention provides a batting aid which spaces its structure at maximal distance from a batter, thereby minimizing distraction of the batter and improving concentration. This is accomplished by having two vertical posts and a horizontal post spanning the vertical posts. The vertical posts are set well apart from one another, and the horizontal post is located considerably above the batter's head.

The invention copes with winding of the tether about the horizontal post in a novel way. The vertical legs each have a flexible joint, so that the batting aid can be temporarily pulled downwardly. The wound up ball is then freed, and the batting aid is returned to its operative position. This action places a slight torque on the vertical posts, which torque is best resisted by securement within the ground. Therefore, horizontal supports resting on the ground would not be suitable.

The vertical posts each penetrate a rigid sleeve driven into the ground. The flexible joint is normally confined within the sleeve, below ground level, so that, normally, the structure resists displacement which occurs when the structure is pulled downwardly. Should a wound tether require access to be freed, the vertical posts are temporarily lifted out of their respective sleeves sufficiently to expose the flexible joints. They are secured in this position by pins obstructing reentry into the sleeves. Now, the structure is readily pulled downwardly for the necessary service. After the batting aid has been corrected, the pins are withdrawn, and the vertical posts assume their normal position penetrating well into the sleeves.

The sleeves may be left permanently in place in the ground. This avoids the necessity of driving a stake or like component into the ground each time the device is utilized. It also avoids the necessity of handling a potentially heavy or unwieldy horizontal support. The batting aid may be seasonally or periodically dismantled for storage, and reassembled at a later date. The sleeves may be capped for safety, and to prevent clogging with debris over time.

The retractable flexible joints are also suitable for supporting other outdoors appliances. Other sports devices, such as basketball hoops, tennis nets, and outdoor tables may employ the novel arrangement. The sleeve can further be employed as a hole for golf, a shallow cap being provided to prevent a golf ball from falling inaccessibly into the sleeve.

Accordingly, it is a principal object of the invention to provide a batting aid which spaces its structure at maximal distance from a batter.

It is another object of the invention selectively to resist displacement of the structure of the batting aid, and to enable the structure to be readily pulled downwardly to free a wound tether.

It is a further object of the invention to provide a flexible joint on each vertical post.

Still another object of the invention is to confine the flexible joint within a rigid enclosure, and to free the flexible joint temporarily from the rigid enclosure.

An additional object of the invention is to provide a flexible joint for sports accessories such as nets, and for other outdoors structures, such as furniture.

It is again an object of the invention to provide permanent ground mounting for a device supported in the ground.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 1 is a side elevational view of the invention, as applied to a batting aid.

FIGS. 4, 5, and 6 are side elevational views of alternative uses of the novel joint, as utilized with a basketball net, a tennis net, and a table, respectively.

DETAILED DESCRIPTION OF THE PREFERRED EMBODIMENTS

Figure 3:
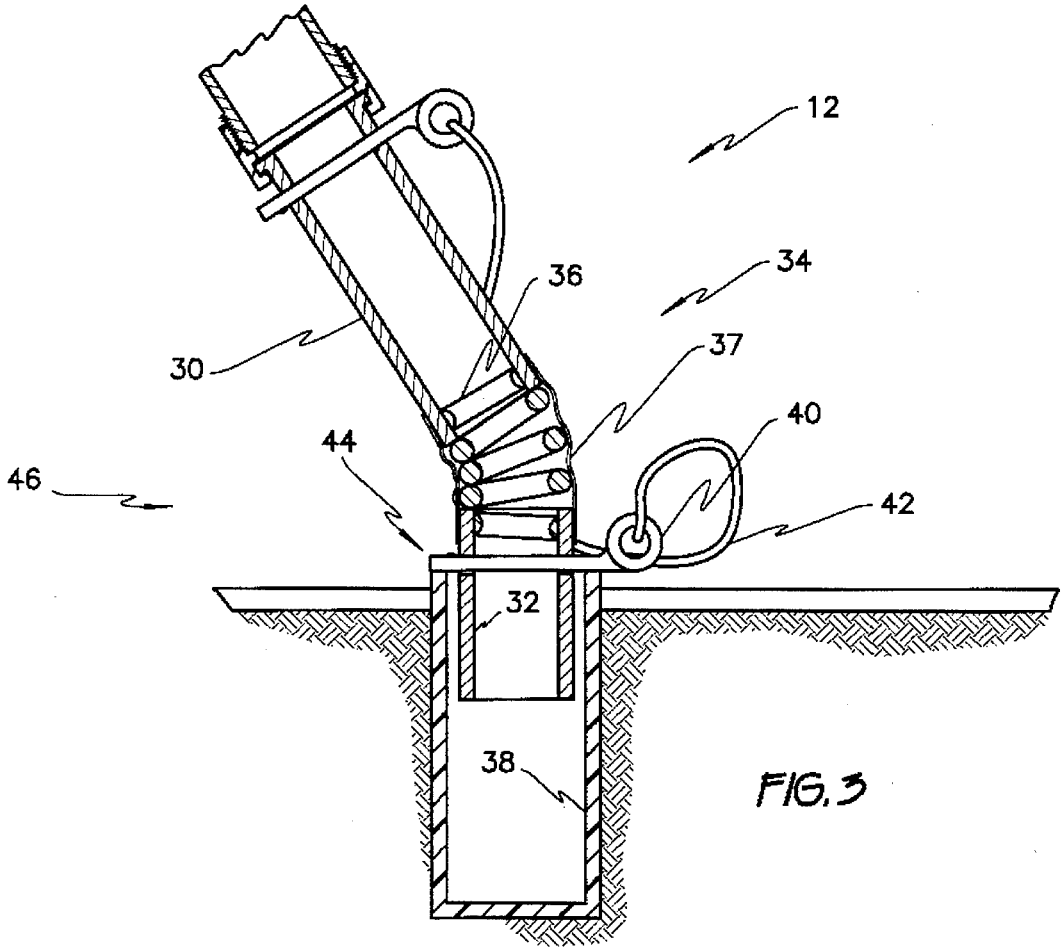
FIG. 3 is a side elevational, cross sectional detail view of the novel flexible joint in its position raised to withdraw the Joint from its sleeve, drawn to enlarged scale.

FIG. 1 of the drawings illustrates a representative application of the present invention as a batting aid 10 for batting practice. Batting aid 10 has two vertical posts 12 and a horizontal post 14 supported by and spanning posts 12. A tether 16 is attached at one end to horizontal post 14, and to a ball 18 or like target object at the other end. Ball 18 is suspended from horizontal post 14 in easy reach of a person practicing batting.

Horizontal post 14 is sufficiently high so that any size person can comfortably stand under it while swinging a bat. Likewise, vertical posts 12 are set apart sufficiently so that a batter is not distracted by proximity of a post 12.

It must be emphasized that a batting aid is not the only possible application of the invention. Any outdoors device which is mounted to the ground and which finds recreational or utilitarian uses may also enjoy the practical benefits of the invention.

Figure 4:
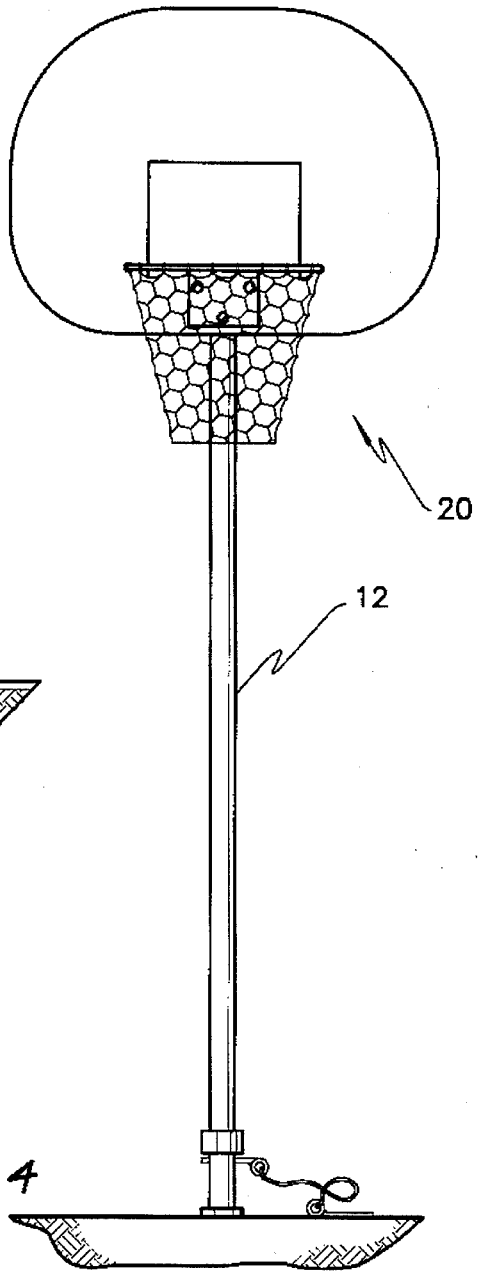

One alternative applications are shown in FIG. 4, wherein a basketball hoop and backboard assembly 20 are mounted atop vertical post 12.

In FIG. 5, the invention accommodates a tennis net 22. For this purpose, there is provided a second vertical post 12. A net 24 is attached to and spans posts 12.

Figure 6:
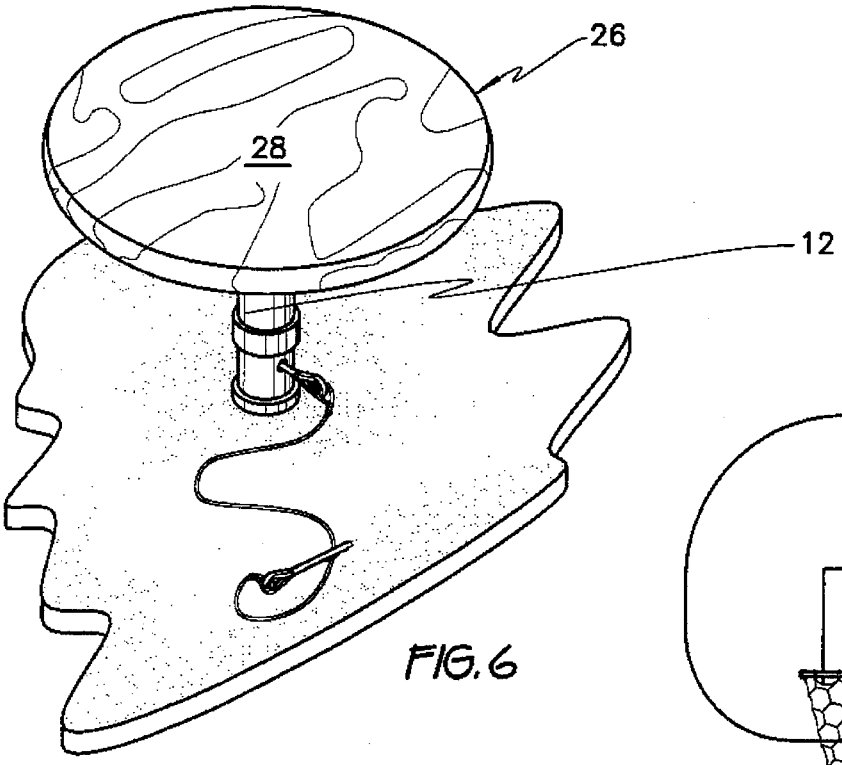

A more utilitarian appliance is illustrated in FIG. 6. A member 26 having a planar upper surface 28 is attached atop post 12 to provide a table.

Figure 2:
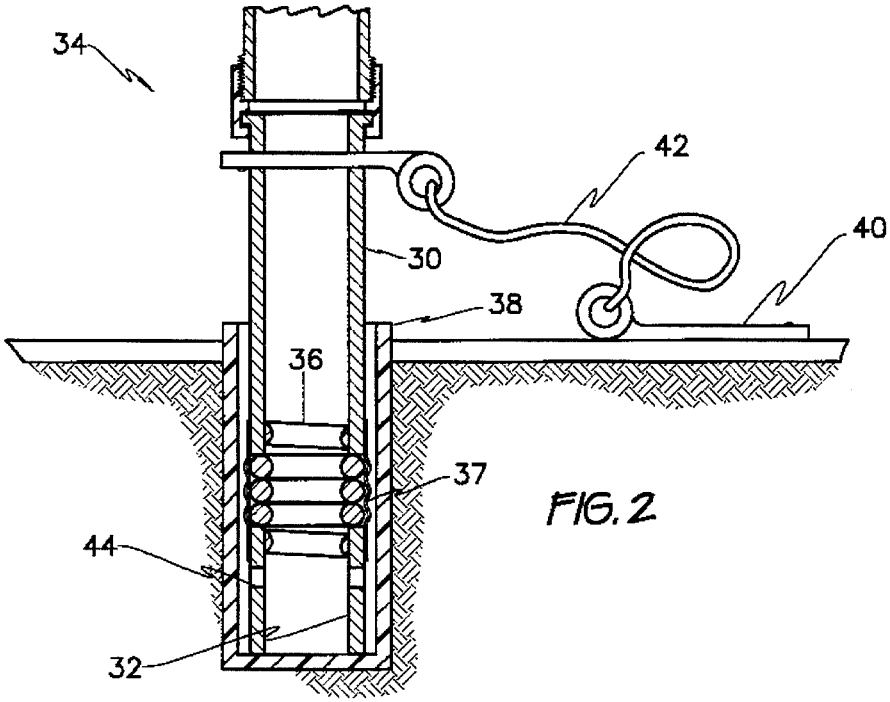
FIG. 2 is a side elevational, cross sectional detail view of the novel flexible joint in its normal position, drawn to enlarged scale.

The principal inventive feature will now be discussed, with reference to FIG. 2. Post 12 is formed in two parts, an upper section 30 and a lower section 32, both sections 30,32 joined by a flexible joint located between the two. Hereinafter, the assembly comprising upper section 30, lower section 32, and the joint will be called a leg 34.

Preferred construction of the joint includes a coil spring 36, which is suitably attached at one end to leg upper section 30 and at the other end to leg lower section 32. This may be accomplished by welding or by any other suitable method. A flexible membrane 37 may be provided to exclude moisture, dust, and other contaminants from leg 34.

Leg 34 is received in a sleeve 38 which has been driven into the ground in preparation of assembly of the appliance. Sleeve 38 fits closely to leg 34, but has sufficient play to enable unopposed insertion and withdrawal of leg 34. Sleeve 38 holds leg 34 upright, and prevents spring 36 from bending. This arrangement causes leg 34 to be vertically oriented whenever fully inserted into sleeve 38.

From time to time, it will be necessary to gain access to the upper portion of the appliance. This is easily accomplished by pulling the upper portion downwardly, towards the ground. Referring now to FIG. 3, the joint is shown flexing to accommodate this action. Leg 34 is grasped and withdrawn from sleeve 38. A pin 40 attached by a tether 42 to upper section 30 of leg 34 is inserted into a hole 44 extending entirely through upper section 30. Leg 34 is released, and will partially reenter sleeve 38. However, spring 36 is entirely free of sleeve 38, and accommodates inclination of the upper portion 32 of leg 34 as the user pulls the upper portion of the appliance downwardly. Pin 40 and its associated hole 44 will be called a stop 46 hereinafter.

It will be appreciated that sleeve 38 is sufficiently long so as to fully surround the lateral surfaces of lower section 32 and spring 36. The lateral surface of upper section 30 is partially surrounded by sleeve 38, at least enough to assure that upright orientation is assured when leg 34 is fully inserted into sleeve 38. When stop 46 is deployed, the joint is maintained out of the sleeve by interference between pin 40 and sleeve 38, thereby arresting downward motion of leg 34 into sleeve 38. When it is desired to replace leg 34 into sleeve 38, pin 40 is withdrawn, and leg 34 is free to reenter sleeve 38.

Figure 7:
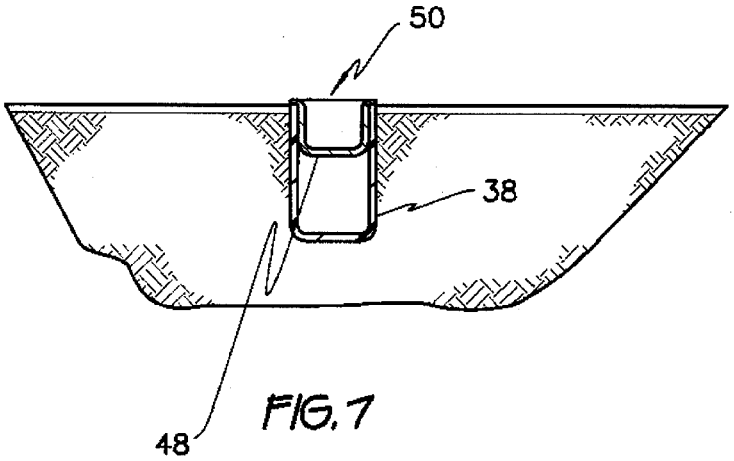
FIG. 7 is a side elevational, cross sectional detail view of a sleeve, capped for use in golf.

The novel construction of leg 34 is suitable for many applications, and each one of the requisite number of legs incorporates the joint as set forth. As shown in FIG. 7, when the appliance is removed, sleeve 38 is sealed by a cooperating cap 48 for safety and to prevent clogging when not in use.

While it is possible to make cap 48 flush with the ground, cap 48 is optionally formed to include an upwardly open concave recess 50. This enables sleeve 38 to be employed in the capacity of a golf putting hole for receiving and storing golf balls. Cap 48 elevates the floor of sleeve 38, so that golf balls remain accessible to a golfer rather than fall inaccessibly to the bottom of sleeve 38.

It is to be understood that the present invention is not limited to the embodiments described above, but encompasses any and all embodiments within the scope of the following claims.

I claim:

1. An outdoors appliance having:

a leg including an upper section, a lower section, and a flexible joint located between and joining said upper section and said lower section of said leg; and a sleeve for being driven into the ground and partially laterally surrounding said upper section of said leg, and fully laterally surrounding said joint and said lower section of said leg when said leg is inserted into said sleeve, wherein when said leg is fully inserted into said sleeve said leg is substantially rigid and when said leg is partially lifted from said sleeve so as to expose said flexible joint portion, said leg is resiliently bendable.

2. The outdoors appliance according to claim 1, further comprising a stop for maintaining said joint out of the sleeve, comprising means defining a hole in said leg, and a pin tethered to said leg and insertable into said hole, said pin interfering with downward motion of said leg into said sleeve.

3. The outdoors appliance according to claim 1, said joint comprising a coil spring fixed at one end to said upper section of said leg, and at the other end of said lower section of said leg.

4. The outdoors appliance according to claim 1, further comprising a cap cooperating with and sealing said sleeve.

5. The outdoors appliance according to claim 4, said cap including means defining an upwardly open concave recess therein, whereby a golf ball is received and accessibly stored in said recess.

6. The outdoors appliance according to claim 1, further comprising:

a second leg including an upper section, a lower section, and a flexible joint located between and joining said upper section and said lower section;

a horizontal post supported at the top of and spanning said leg and said second leg; and a tether attached to said horizontal post at one end, and fastened to a ball at the other end, whereby said ball is tethered to said horizontal post, and is suspended therefrom, for batting practice.

7. The outdoors appliance according to claim 1, further comprising:

a second leg including an upper section, a lower section, and a flexible joint located between and joining said upper section and said lower section; and a net attached to and spanning said leg and said second leg.

8. The outdoors appliance according to claim 1, further comprising a basketball hoop and backboard assembly attached atop said leg.

9. The outdoors appliance according to claim 1, further comprising a member having a planar upper surface attached atop said leg.

10. An outdoors appliance having:

a leg including an upper section, a lower section, a flexible joint located between and joining said upper section and said lower section of said leg, and a flexible cover covering said flexible joint;

a sleeve for being driven into the ground and partially laterally surrounding said upper section of said leg, and fully laterally surrounding said joint, said cover, and said lower section of said leg when said leg is inserted into said sleeve, wherein when said leg is fully inserted into said sleeve said leg is substantially rigid and when said leg is partially lifted from said sleeve so as to expose said flexible joint portion, said leg is resiliently bendable.

* * * * *